United States Patent [19]

Kadija et al.

[11] 4,409,085

[45] Oct. 11, 1983

[54] DIAPHRAGM CELLS EMPLOYING RETICULATE CATHODES

[75] Inventors: Igor V. Kadija; Kenneth E. Woodard, Jr., both of Cleveland, Tenn.

[73] Assignee: Olin Corporation, Hew Haven, Conn.

[21] Appl. No.: 330,637

[22] Filed: Dec. 15, 1981

[51] Int. Cl.[3] ..... C25B 9/00; C25B 11/03; C25B 13/06

[52] U.S. Cl. ..... 204/257; 204/263; 204/283; 204/290 R; 204/295

[58] Field of Search ..... 204/252-258, 204/263-266, 283-284, 290 R, 295

[56] References Cited

U.S. PATENT DOCUMENTS

| | | | |
|---|---|---|---|
| 1,152,772 | 9/1915 | Wheeler | 204/283 |
| 3,344,053 | 9/1967 | Neipert et al. | 204/283 X |
| 3,989,615 | 11/1976 | Kiga et al. | 204/283 X |
| 4,332,662 | 6/1982 | Pouli et al. | 204/283 X |

FOREIGN PATENT DOCUMENTS 1211428 11/1970 United Kingdom .

OTHER PUBLICATIONS

Volkman, Y., "Optimization of the Effectiveness of a Three-Dimensional Electrode with Respect to its Ohmic Variables", 10-26-78, pp. 1145-1149.

Tentorio, A. and U. Casolo-Ginelli, "Characterization of Reticulate Three-Dimensional Electrodes", Journal of Applied Electrochemistry, (1978), pp. 195-205.

*Primary Examiner*—Donald R. Valentine

*Attorney, Agent, or Firm*—James B. Haglind; Donald F. Clements

[57] ABSTRACT

An electrolytic diaphragm cell for the electrolysis of an aqueous solution of an alkali metal chloride is comprised of a cell body having a porous diaphragm separating the cell body into an anode compartment and a cathode compartment. The anode compartment contains at least one anode and the cathode compartment contains at least one cathode. The cathode is comprised of a formaminous metal conductor and a reticulate cathode, with the reticulate cathode being positioned between and in contact with the porous diaphragm and the foraminous metal conductor. The cell has means adapted to supply electric current to the anodes and the cathodes, nd inlets and outlets in the cell body adapted to supply and remove fluids. The electrolytic diaphragm cell of the present invention operates at reduced electrical power consumption by employing three dimensional cathodes having increased internal surface area and increased porosity.

10 Claims, 2 Drawing Figures

DIAPHRAGM CELLS EMPLOYING RETICULATE CATHODES

This invention relates to electrolytic diaphragm cells. More particularly, this invention relates to cathodes for electrolytic diaphragm cells having high surface areas.

In electrolytic cells employed in the electrolysis of aqueous solutions of ionizable compounds such as alkali metal chlorides, foraminous metal electrodes are used which are constructed of perforated plates, meshes or screens, and expanded metals. These electrodes employ significant amounts of metal and have a high ratio of metal weight to surface area and significant polarization values. As the cost of electric power has increased, various ways have been sought to increase the surface area of these electrodes and to reduce their polarization values and thus lower the power consumption for their operation.

One method of reducing polarization values of these prior art electrodes is to employ expensive catalysts to reduce the electrode charge transfer activation barrier. Using these materials, any savings resulting from a reduction of power consumption has been offset by the increase in costs for the electrodes. In addition, these catalysts have a relatively short operational life.

A more recent attempt to increase the surface area of electrodes has been the development of the three dimensional electrodes such as reticulate electrodes. A. Tentorio and U. Casolo-Ginelli have described one type of reticulate electrode (*J. Applied Electro-Chemistry* 8, 195–205, 1978) in which an expanded, reticulated polyurethane foam was metallized by means of the electroless plating of copper. A thin layer of copper (about 0.34 m) was formed which conferred electrical conductivity to the matrix. Galvanic plating was employed to deposit additional amounts of copper. The reticulate electrode was employed in a cell for the electrolysis of a copper sulfate solution. This reticulate electrode, however, requires two separate electroplating operations which increases both the time required and the cost of fabrication. In addition, the geometrical configuration of the foam makes it difficult to obtain uniform coating of the substrate.

There is a need for electrodes for electrolytic cells having increased surface area to reduce electrical power consumption.

It is an object of the present invention to provide a diaphragm electrolytic cell having cathodes with increased surface area.

Another object of the present invention is to provide a diaphragm electrolytic cell having cathodes of increased porosity.

A further object of the present invention is to provide a diaphragm electrolytic cell having cathodes which operate at reduced electrical power consumption.

These and other objects of the invention are accomplished in an electrolytic diaphragm cell for the electrolysis of an aqueous solution of an alkali metal chloride which comprises:

(a) a cell body;

(b) a porous diaphragm separating the cell body into an anode compartment and a cathode compartment;

(c) the anode compartment containing at least one anode;

(d) the cathode compartment containing at least one cathode, the cathode being comprised of a foraminous metal conductor and a reticulate cathode, the reticulate cathode being positioned between and in contact with the porous diaphragm and the foraminous metal conductor;

(e) means adapted to supply electric current to the anodes and the cathode; and (f) inlets and outlets in the cell body adapted to supply and remove fluids from the cell body.

Additional advantages of the invention will become apparent upon reading the description below and the invention will be better understood by reference to the attached FIGURES.

Figures 1, 2:
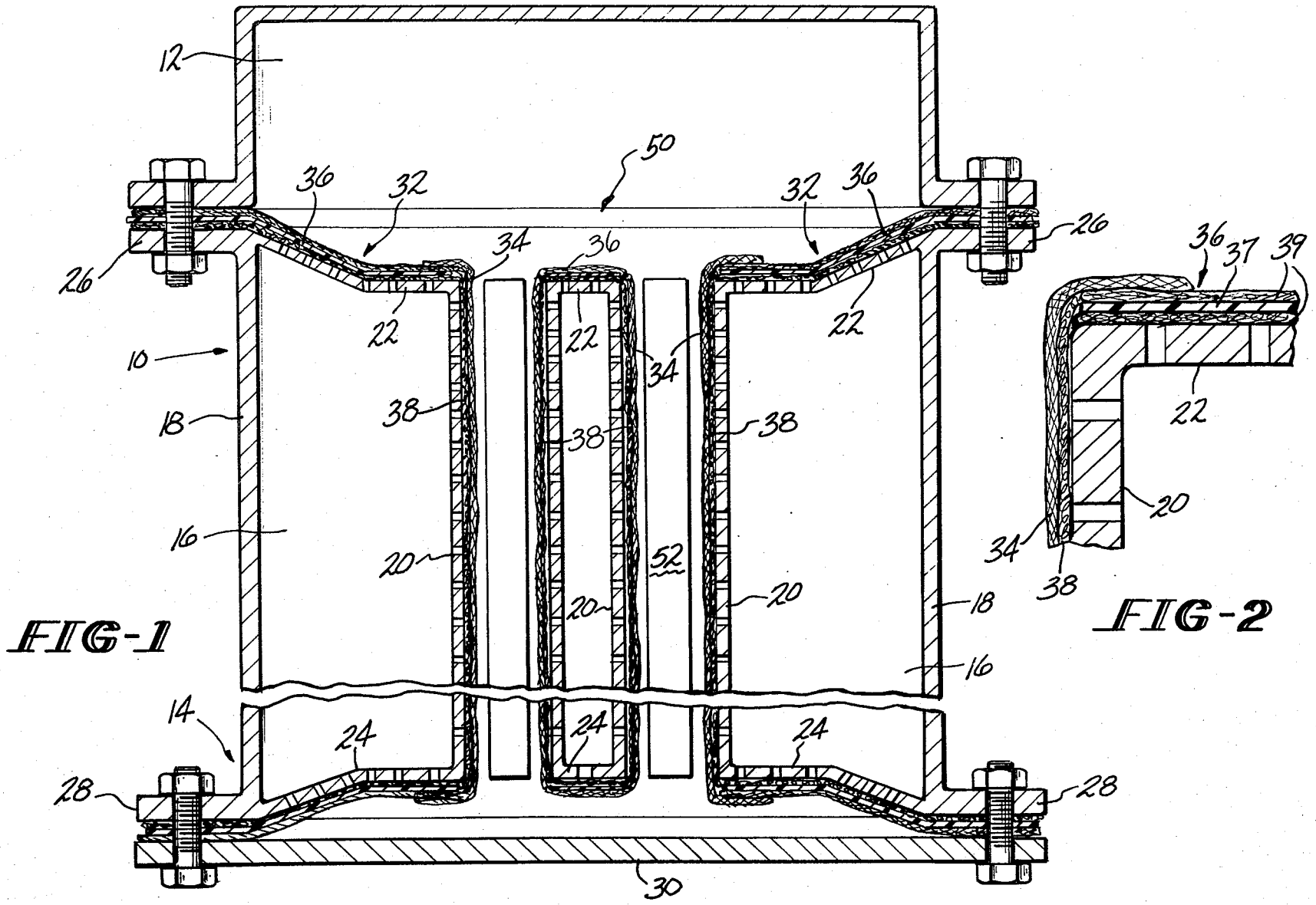
FIG. 1 shows an end view of a cross section of an electrolytic diaphragm cell employing the novel cathode structure of the present invention.
FIG. 2 illustrates an enlarged partial section of FIG. 1.

FIG. 1 shows electrolytic diaphragm cell 10 having cover 12 and cell body 14. Cell body 14 contains cathode assembly 50 comprised of enclosure 16 and reticulate cathode 38. Enclosure 16 includes external walls 18, foraminous walls 20, foraminous top sections 22 and foraminous bottom sections 24. External walls 18 have upper flanges 26 and lower flanges 28 which are utilized to seal in a liquid tight manner cell body 14 to cover 12 and cell bottom 30. Reticulate cathodes 38 are positioned along and in contact with foraminous walls 20 of enclosure 16.

Reticulate cathodes 38 are covered with porous diaphragm 34. Anodes 52 are inserted between and spaced apart from adjacent reticulate cathodes 38 covered with porous diaphragm 34. Foraminous top sections 22 and foraminous bottom sections 24 are covered by substantially fluid impervious material 36. Reticulate cathodes 38 are attached to substantially fluid impervious material 36. Impervious material 36 is extended to cover upper flanges 26 and bottom flanges 28 as a gasket material.

FIG. 2 presents an enlarged section of FIG. 1 showing a portion of foraminous wall 20 of external cathode 16 covered by reticulate cathode 38. Reticulate cathode 38 has deposited thereon porous diaphragm 34 where porous diaphragm 34 is comprised of asbestos fibers. A portion of foraminous top section 32 of enclosure 16 is covered by substantially fluid impervious material 36. Substantially fluid impervious material 36 is comprised of film layer 37 bonded to fabric layers 39. Reticulate cathode 38 is attached to substantially fluid impervious material 36. Porous diaphragm 34 is deposited along the end portion of substantially fluid impervious material 36.

One component of the novel cathode structure of the diaphragm cell of the present invention is a reticulate cathode, a three dimensional structure which is highly conductive, is highly porous, and has an extensive amount of internal surface area. Reticulate cathodes have a thickness in the range of from about 1 to about 5, preferably from about 2 to about 4 millimeters and are light in weight, having, for example, from about 2 to about 80 percent, and preferably from about 10 to about 20 percent of the weight of conventional mesh or screen electrodes of the same metallic composition.

The porosity of the reticulate cathodes is above about 80 percent, preferably above about 90 percent, and more preferably in the range of from about 95 to about 98 percent. The porosity is defined as the ratio of the void to the total volume of the reticulate electrode.

At thicknesses in the range described above, the reticulate cathodes of the present invention have internal surface areas of from about 150 to about 680, and preferably from about 330 to about 550 square centimeters per square centimeter of the projected cathode area. The projected cathode area is that which is in contact with the foraminous metal conductor. The internal surface area of the reticulate cathodes is from about 30 to about 310 times the internal surface area of a metal mesh cathode commonly employed in chlor-alkali diaphragm cells having a porosity in the range of 50 to 75 percent and of equal thickness.

The extensive internal surface area of the reticulate cathodes is readily accessible to the electrolyte and hence the current than are conventional electrodes. As a result, the polarization values of reticulate cathodes are lower.

A preferred embodiment of the reticulate cathodes is that of a network of filaments having a high degree of interfilament bonding provided by the deposition of an electroconductive metal at contact sites between adjacent filaments.

The term "filaments" as used in this specification includes fibers, threads, or fibrils. The filaments may be those of the electroconductive metals themselves, for example, nickel, titanium, or steel; or of materials which can be coated with an electroconductive metal.

Any materials which can be electroplated with these electroconductive metals may be used. Suitable materials include, for example, metals such as silver or copper, plastics such as polyarylene sulfides, polyolefins produced from olefins having 2 to about 6 carbon atoms and their chloro- and fluoro-derivatives, nylon, melamine, acrylonitrile-butadiene-styrene (ABS), and mixtures thereof.

Where the filaments to be coated are non-conductive to electricity, it may be necessary to sensitize the filaments by applying a metal such as silver, nickel, aluminum, palladium, or their alloys by known procedures. The electroconductive metal is then deposited on the sensitized filaments.

In one embodiment, the filaments are affixed to a support fabric prior to the deposition of the electroconductive metal. Any fabric may be used as the support fabric which can be removed from the reticulate electrode structure either mechanically or chemically. Support fabrics include those which are woven or non-woven and can be made of natural fibers such as cotton or rayon or synthetic fibers including polyesters, nylons, polyolefins such as polyethylene, polypropylene, polybutylene, polytetrafluoroethylene, or fluorinated ethylene-propylene (FEP) and polyarylene compounds such as polyphenylene sulfide. Preferred as support fabrics are those of synthetic fibers such as polyesters or nylon. Fabric weights of 100 grams per square meter or higher are quite suitable for the support fabrics.

Filaments are fixed to the support fabric in arrangements which provide a web or network having the desired porosity. The filaments are preferably randomly distributed while having a plurality of contact points with adjacent filaments. This can be accomplished by affixing individual filaments in the desired arrangement or by providing a substrate which includes the filaments. Suitable substrates are lightweight fabrics having a fabric weight in the range of from about 4 to about 75 grams per square meter. A preferred embodiment of the substrate is a web fabric of, for example, a polyester or nylon.

Filaments may be affixed to the support fabric or the substrate, for example, by sewing or needling. Filaments can be affixed to a thermoplastic material by employing energy sources such as heat or ultrasonic waves. It may also be possible to affix the filaments by the use of an adhesive.

An electroconductive metal is then deposited on the filaments, for example, by electroplating. Any electroconductive metal may be used which is suitable as a cathode in the cell environment in which the cathode will be used and which does not interact with other cell components.

Examples of suitable electroconductive metals include nickel, nickel alloys, molybdenum, molybdenum alloys, vanadium, vanadium alloys, iron, iron alloys, cobalt, cobalt alloys, platinum group metals, and platinum group metal alloys. The term "platinum group metal" as used in the specification means an element of the group consisting of platinum, ruthenium, rhodium, palladium, osmium, and iridium.

During the deposition of the electroconductive metal, interfilament bonding occurs where the filaments contact each other as the deposited metal "grows" over and encloses the contact site. As there are many contact sites between filaments in the structure, interfilament bonding occurs frequently and the electrode structure produced is mechanically strong.

Sufficient amounts of the electroconductive metal are deposited on the filaments to produce an electrode structure having adequate mechanical strength and which is sufficiently ductile to withstand the stresses and strains exerted upon it during its use in electrolytic processes without cracking or breaking. Suitable amounts of electroconductive metals include those which increase the diameter of the filaments up to about 5 times and preferably from about 2 to about 4 times the original diameter of the filaments. While greater amounts of electroconductive metal may be deposited on the filaments, extra heavily coated filaments tend to become brittle and to powderize. Prior to the deposition of the electroconductive metal, the filaments have diameters in the range of from about 1 to about 100, preferably from about 2 to about 50, and more preferably from about 5 to about 15 microns. Following the deposition of the electroconductive metal, the filaments have diameters in the range of from about 2 to about 200, preferably from about 6 to about 150, and more preferably from about 15 to about 75 microns.

After deposition of the electroconductive metal has been accomplished, the support fabric is removed. With cloth-like fabrics, these can be readily peeled off or cut off the metal structure. Non-woven or felt support fabrics can be, for example, loosened or dissolved in solvents including bases such as alkali metal hydroxide solutions. Any solvent may be used to remove the support fabrics and substrates which will not corrode or detrimentally effect the electrode structure. Heating may also be employed, if desired, to remove the support fabrics.

In electrical and physical contact with the reticulate cathode is a foraminous metal structure, for example, wall 20 of enclosure 16 of FIGS. 1 and 2, which serves as the current conductor to the reticulate cathode. The foraminous metal structure is a screen, mesh or expanded metal having limited internal surface area, a porosity of from about 30 to about 90, and preferably from about 75 to about 90 percent and a thickness of from about 1 to about 5 millimeters. Suitable metals include steel, nickel, and their alloys. For example, current collectors for reticulate cathodes operated at current densities of 2–3 KA/square meter comprised of wire screens having a thickness of about 1.5 to about 3 millimeters and openings in the range of 10×10 to 20×20 millimeters are quite adequate. To provide additional sites for the nucleation and release of hydrogen gas bubbles, the side of the foraminous metal structure opposite that in contact with the reticulate cathode may be coated with a polyhaloolefin such as polytetrafluoroethylene, polyvinyl fluoride, polyvinylidene fluoride, polychlorotrifluoroethylene (PCTFE), polyvinyl chloride (PVC), polyvinylidene chloride (PVDC), chlorinated polyvinylchloride (C-PVC), fluorinated ethylene-propylene copolymer (FEP), ethylene-chlorotrifluoroethylene copolymer (E-CTFE), ethylene-tetrafluoroethylene copolymer (ETFE), perfluoroalkoxy resin (PFA) and TEFLON® EPE. Preferred embodiments of polyhaloolefins are polyfluoroolefins selected from the group consisting of polytetrafluoroethylene, fluorinated ethylene-propylene copolymer, ethylene-chlorotrifluoroethylene copolymer, polyvinylidene fluoride and ethylene-tetrafluoroethylene copolymer.

Bus bars are attached to the foraminous metal structure, for example, by welding, to receive current from the reticulate cathode.

Where the reticulate cathode is formed in the cell by deposition of an electroconductive metal on an array of filaments, good electrical contact between the foraminous metal structure and filaments is required. This can be accomplished in suitable ways including the use of pressure means such as clamps or contact means such as current distributors having filament-engaging means. In electrolytic cells having expandable anodes, by placing spacer means between the support fabric and the face of the anode in the expanded mode, sufficient pressure can be exerted to provide good contact between the filaments and the foraminous metal structure during electrodeposition of the electroconductive metal.

The novel cathode structure of the diaphragm cell of the present invention has deposited on the reticulate cathode a porous diaphragm of, for example, asbestos fibers. The cathode structure is immersed in a slurry of the fibers and a diaphragm formed by vaccum deposition. In addition to the fibers, the slurries may contain thermoplastic resins, including halocarbon polymers such as vinyl fluoride, vinylidene fluoride, trifluoroethylene, perfluoroethylene, vinylidene chloride, chlorotrifluoroethylene, and copolymers, for example, of olefins and haloolefins, i.e., of ethylene and chlorotrifluoroethylene. The fibers and resin particles, where present, are sucked onto the outer surface of the reticulate cathode until a diaphragm of the desired thickness is formed. After discontinuing the suction, water is removed from the deposited diaphragm, for example, by air drying or heating at temperatures up to about 100° C. for several hours. The electrode is then heated at higher temperatures, for example, up to about 350° C. for a short period to complete the diaphragm fabrication.

Another embodiment of a porous diaphragm which can be employed in the novel electrolytic cell of the present invention is comprised of a porous fabric impregnated with a gel-forming magnesium-containing silicate mineral. Porous fabrics employed in the porous diaphragms are those comprised of thermoplastic materials including polyolefins or polyarylene compounds. Suitable polyolefins include polymers of olefins having from about 2 to about 6 carbon atoms in the primary chain as well as their chloro- and fluoro-derivatives.

Examples include polyethylene, polypropylene, polybutylene, polypentylene, polyhexylene, polyvinyl chloride, polyvinylidene chloride, polytetrafluoroethylene, fluorinated ethylene-propylene (FEP), polychlorotrifluoroethylene, polyvinyl fluoride, polyvinylidene fluoride, and copolymers of ethylene-chlorotrifluoroethylene.

Preferred olefins include the chloro- and fluoro-derivatives such as polytetrafluoroethylene, fluorinated ethylene-propylene, polychlorotrifluoroethylene, polyvinyl fluoride, and polyvinylidene fluoride.

Polyarylene compounds which can be used to produced porous fabrics include polyphenylene, polynaphthylene and polyanthracene derivatives. For example, polyarylene sulfides such as polyphenylene sulfide or polynaphthylene sulfide.

Fabric forms employed are those which promote absorption of the active gel-forming component including sponge-like fabric forms. Preferred forms of the thermoplastic porous fabrics include felt fabrics and napped fabrics. The felt fabrics have a weight of from about 100 to about 400 and preferably from about 150 to about 300 grams per square meter. The thickness of the felt fabrics is from about 1.00 to about 8.50, and preferably from about 1.5 to about 5 millimeters. In one embodiment, the felt fabric is employed in combination with a lightweight open fabric such as a scrim fabric. The lightweight open fabrics have a weight of from about 25 to about 200, and preferably from about 50 to about 125 grams per square meter. The lightweight open fabric is attached to the porous fabric by needling or sewing. The filaments comprising the reticulate cathode, preferably in web form, are attached to the lightweight fabric.

Napped fabrics include those having a smooth surface on one side and a napped or fuzzy surface on the opposite side. Napped fabrics have a weight of from about 100 to about 400, and preferably from about 200 to about 300 grams per square meter. Filaments of the reticulate cathode are attached to the smooth side of the napped fabric with the napped surface being placed in contact with the foraminous metal conductor.

In the above embodiments employing a napped fabric or a lightweight fabric combined with a felt fabric, where the filaments of the reticulate cathode are attached thereto, the support fabric, previously described, can be eliminated.

Electrolytically non-active sections of the cathode structure, as shown in FIGS. 1 and 2, are covered by a substantially fluid impervious structure.

The substantially fluid impervious structure has at least two layers. One layer is a substantially fluid impervious film of a synthetic thermoplastic resin. Examples of suitable synthetic thermoplastic resins include halogenated polyolefins, such as polyvinyl chloride, polyvinylidene chloride, polytetrafluoroethylene, fluorinated ethylene-propylene (FEP), polychlorotrifluoroethylene, polyvinyl fluoride, polyvinylidene fluoride, polymerized perfluoroalkyls having the formula $CF_2CF_2CFO(CnF_{2n-1})CF_2CF_2$, where n is from 1 to about 10, and copolymers thereof, where the halogens are chlorine or fluorine.

The thermoplastic film layer may be any suitable thickness, for example, from about 1 to about 25 mils.

A preferred thermoplastic film is that which is available commercially as an "activated" film.

The second layer of the impervious structure is a thermoplastic fabric material. Suitable fabrics for the impervious portion of the diaphragm structure include felt fabrics, non-woven fabrics and napped fabrics, with felt fabrics and napped fabrics being preferred. Fabric layers are preferably those having a light weight, for example, from about 140 to about 575 grams per square meter.

Materials which are suitable for use in the fabric layer of the impervious portion of the diaphragm structure as well as for the porous fabric used to support the asbestos fibers include thermoplastic materials such as polyolefins which are polymers of olefins having from about 2 to about 6 carbon atoms in the primary chain as well as their chloro- and fluoro-derivatives.

Examples of suitable polyolefin materials used as materials of construction of the fabric layer include polyethylene, polypropylene, polybutylene, polypentylene, polyhexylene, polyvinyl chloride, polyvinylidene chloride, polytetrafluoroethylene, fluorinated ethylene-propylene (FEP), polychlorotrifluoroethylene, polyvinyl fluoride, polyvinylidene fluoride, and copolymers of ethylene-chlorotrifluoroethylene.

Preferred olefins include the chloro- and fluoro- derivatives such as polytetrafluoroethylene, fluorinated ethylene-propylene (FEP), polychlorotrifluoroethylene, polyvinyl fluoride, and polyvinylidene fluoride.

Also suitable are polyaromatic compounds such as polyarylene compounds. Polyarylene compounds include polyphenylene, polynaphthylene and polyanthracene derivatives. Preferred are polyarylene sulfides such as polyphenylene sulfide or polynapthylene sulfide.

In selecting materials for the substantially fluid impervious film layer and fabric layer of the substantially fluid impervious structure, thermoplastic materials in the film layer preferably have a lower melting point to permit bonding to the fabric layer, for example, by heat sealing at temperatures which will not thermally damage the fabric layer.

In a preferred embodiment, the substantially fluid impervious structure is comprised of two layers of fabric material separated by the film layer. A suitable example comprises a film layer of fluorinated ethylene-propylene placed between two layers of a polytetrafluoroethylene felt fabric. The layers may be bonded, for example, by sealing with energy forms such as heat or ultrasonic vibrations.

By applying, for example, heat and pressure, the substantially fluid impervious film is melted to the extent that it allows partial incorporation of the fibers of the fabric. This incorporation of fibers into the film layer improves the mechanical properties of the film and strengthens the substantially fluid impervious layer.

When bonding the fabric layer to the film layer, suitable temperatures are those from about 100° C. to those at which the thermoplastic fabric suffers minimal thermal decomposition. Preferred temperatures are those in the range from about 200° to about 300° C. Suitable pressures are those in the range of from about 0.05 to about 14, and preferably from about 1.4 to about 10.5 kilograms per square centimeter.

The substantially fluid impervious structure is placed on the electrolytically non-active portions of the cathode structure. In a preferred embodiment, the substantially fluid impervious structure is attached to the filament web-support fabric of the reticulate cathode, for example, by stitching, prior to the deposition of the electroconductive metal or the porous asbestos diaphragm.

Electrolytic diaphragm cells in which the novel cathode structure of the present invention may be used are those, for example, which are employed commercially in the production of chlorine and alkali metal hydroxides by the electrolysis of alkali metal chloride brines. Alkali metal chloride brines electrolyzed are aqueous solutions having high concentrations of the alkali metal chlorides. For example, where sodium chloride is the alkali metal chloride, suitable concentrations include brines having from about 200 to about 350, and preferably from about 250 to about 320 grams per liter of NaCl. The cells have an anode compartment containing a plurality of foraminous metal anodes, a cathode compartment having a plurality of the novel cathodes with an asbestos diaphragm separating the anode compartment from the cathode compartment. Suitable electrolytic cells include, for example, those types illustrated by U.S. Pat. Nos. 1,862,244; 2,370,087; 2,987,463; 3,247,090; 3,477,938; 3,493,487; 3,617,461; 3,462,604; and 3,898,149.

The following example is presented to illustrate more fully the invention without any intention of being limited thereby. All parts and percentages are by weight unless otherwise indicated.

EXAMPLE 1

A web of silver coated nylon fibers (20 grams per square meter; fiber diameter about 10 microns) was needled onto one side of a section of a polyester cloth (250 grams per square meter; air permeability 50 cubic meters per minute per square meter). The web-polyester cloth section was cut to fit the electrolytically active areas of a perforated steel screen conductor 1.6 mm thick and having a porosity of 68 percent. To cover the electrolytically non-active areas of the conductor, a substantially fluid impervious material was formed by inserting a layer of an impervious fluorinated ethylene-propylene film (Livingston Coatings, Inc. activated film) about 0.015 centimeter thick between two layers of polytetrafluoroethylene felt fabric (weight—283.5 grams per square meter).

Fabrication of the impervious layered material was completed by heat sealing the layers at a temperature of 275° C. under a pressure of 41.6 kg/sq. cm. The fluid impervious material was then stitched to the web-polyester section. In an electrolytic cell of the type of FIG. 1, the electrolytically active areas of the steel mesh conductors were covered with the web-polyester cloth combination, with the web in direct contact with the steel screen. The cell was equipped with anodes of titanium coated with a ruthenium metal oxide. To assure good electrical contact between the steel screen and the web, polytetrafluoroethylene spacers were placed between the anode plates and the polyester cloth. The anodes were expanded to compress the spacers against the polyester cloth. The cell was filled with an electroplating bath containing 450 grams per liter of nickel sulfamate and 30 grams per liter of boric acid at a pH in the range of 3–5.

Initially electric current was passed through the electroplating solution at a current density of about 0.2 $KA/m^2$ of cathode surface. After about 10 minutes, the current was increased to provide a current density of 0.5 $KA/m^2$. During the electroplating period of about 3 hours, an electroconductive nickel coating was deposited on the silver fibers. Where adjacent fibers touched, plated joints formed to bond the fibers together into a network, forming a reticulate cathode. The electroplating bath was drained from the cell, the anodes removed, and the cell and cathode structure washed thoroughly with water to remove any plating bath remaining. A caustic soda solution (20% by weight of NaOH) was fed to the cell to aid in the removal of the polyester fabric from the reticulate electrode. After removing the polyester fabric, the cathode assembly comprised the steel mesh conductor and a nickel reticulate cathode having a thickness of 3 mm. and a porosity of 96 percent. A slurry of asbestos fibers in cell liquor containing 13.5 percent by weight of NaOH and 12.2 percent by weight of NaCl was added to the cell. Admixed with the asbestos fibers was 5 percent by weight of an ethylenechlorotrifluoroethylene copolymer resin (E-CTFE). Initially a vacuum of 50–100 mm Hg was imposed for a period of about 5 minutes. The vacuum was increased to about 560 mm Hg for a period of about 10 minutes to deposit about 1.4 kg/m$^2$ of asbestos fibers on the reticulate nickel electrode and along the areas adjoining the reticulate electrode and the substantially fluid impervious material. After sufficient asbestos fibers had been deposited as a mat on the reticulate cathode, the vacuum was discontinued.

The cathode assembly having the asbestos diaphragm deposited thereon was air dried for about 45 minutes. Curing was completed by gradually heating the entire structure up to 275° C. and maintaining this temperature for about 90 minutes.

The cathode assembly with the asbestos diaphragm and the ruthenium oxide coated titanium mesh anodes were reinstalled in the cell. The anode compartment was filled with sodium chloride brine at a pH of 12, a concentration of 300+5 grams per liter of NaCl and a temperature of 90° C. Electrolysis was conducted employing a current density of 2.33 kiloamps per square meter of anode surface. The cell was operated for a period of 56 days at a cell voltage of 3.42–3.44 volts and a cathode current efficiency of 91–92 percent to produce chlorine gas, hydrogen gas, and a caustic solution containing 125–145 grams per liter of NaOH.

COMPARATIVE EXAMPLE

The electrolytically non-active areas of a steel mesh conductor identical to that of EXAMPLE 1 were covered with the substantially fluid impervious felt structure. An asbestos diaphragm identical to that used in EXAMPLE 1 was deposited on the steel mesh conductor, dried and cured under the same conditions as that of EXAMPLE 1.

The cathode assembly was installed in an electrolytic cell of the type shown in FIG. 1. Ruthenium oxide coated titanium mesh anodes were installed in the cell and the anode compartment was filled with sodium chloride brine at a pH of 12, a concentration of 300+5 grams per liter of NaCl and a temperature of 90° C. Electrolysis was conducted employing a current density of 2.33 kiloamps per square meter of anode surface. The cell was operated for a period of 56 days at a cell voltage of 3.52–3.55 volts and a cathode current efficiency of 91–92 percent to produce chlorine gas, hydrogen gas, and a caustic solution containing 126–140 grams per liter of NaOH.

Employing the reticulate cathode in the cell of EXAMPLE 1 resulted in the substantial reduction of 0.1 volts in the cell voltage in comparison to the steel mesh cathode of the COMPARATIVE EXAMPLE while maintaining the same cathode current efficiencies and the strength of the caustic solutions produced.

What is claimed is:

1. An electrolytic diaphragm cell for the electrolysis of an aqueous solution of an alkali metal chloride which comprises:
   (a) a cell body;
   (b) a porous diaphragm separating said cell body into an anode compartment and a cathode compartment;
   (c) said anode compartment containing at least one anode;
   (d) said cathode compartment containing at least one cathode, said cathode being comprised of a foraminous metal conductor and a reticulate cathode, said reticulate cathode being comprised of a network of electroconductive filaments having interfilament bonding formed by deposition of an electroconductive metal at contact sites between adjacent filaments, and having a porosity of at least 80 percent, said reticulate cathode being positioned between and in contact with said porous diaphragm and said foraminous metal conductor;
   (e) means adapted to supply electric current to said anodes and said cathodes; and
   (f) inlets and outlets in said cell body adapted to supply and remove fluids from said cell body.

2. The electrolytic diaphragm cell of claim 1 in which said porous diaphragm is comprised of asbestos fibers deposited on said reticulate cathode.

3. The electrolytic diaphragm cell of claim 2 in which said filaments are comprised of a plastic selected from the group consisting of polyarylene sulfides, polyolefins produced from olefins having 2 to about 6 carbon atoms and their chloro- and fluoroderivatives, and nylon, said filaments having coated thereon an electroconductive metal selected from the group consisting of nickel, nickel alloys, molybdenum, molybdenum alloys, cobalt, cobalt alloys, platinum group metals and platinum group metal alloys.

4. The electrolytic diaphragm cell of claim 3 in which said reticulate cathode is comprised of nylon filaments having an electroconductive coating thereon of nickel or a nickel alloy.

5. The electrolytic diaphragm cell of claim 4 in which said reticulate cathode has a porosity of from about 95 to about 98 percent.

6. The electrolytic diaphragm cell of claim 5 in which said reticulate cathode has an internal surface area of from about 150 to about 850 square centimeters per square centimeter of the projected cathode area.

7. The electrolytic diaphragm cell of claim 2 in which said foraminous metal conductor has an electrochemically active area and an electrochemically non-active area, said electrochemically non-active area being covered by a substantially fluid impervious material.

8. The electrolytic diaphragm cell of claim 7 in which said substantially fluid impervious material is comprised of a fabric layer attached to a substantially fluid impervious film layer.

9. The electrolytic diaphragm cell of claim 8 in which said fluid impervious film layer is comprised of a fluorinated olefin selected from the group consisting of polytetrafluoroethylene, fluorinated ethylene-propylene (FEP), polychlorotrifluoroethylene, polyvinylfluoride, and polyvinylidene fluoride.

10. The electrolytic diaphragm cell of claim 9 in which said fabric layer of said substantially fluid impervious material is selected from the group consisting of a felt fabric and a napped fabric.

* * * * *

UNITED STATES PATENT AND TRADEMARK OFFICE

CERTIFICATE OF CORRECTION

PATENT NO. : 4,409,085

DATED : October 11, 1983

INVENTOR(S) : Igor V. Kadija and Kenneth E. Woodard, Jr.

It is certified that error appears in the above-identified patent and that said Letters Patent is hereby corrected as shown below:

On the title page, in the Abstract, line 13, after "cathodes," delete "nd" and insert --and--.

Column 3, line 57, delete "fixed" and insert --affixed--.

Column 9, line 35, after "300" delete "+" and insert --±--.

Column 9, line 56, after "300" delete "+" and insert --±--.

Column 10, Claim 3, line 34, delete "fluoroderivatives" and insert --fluoro- derivatives--.

Signed and Sealed this

Sixth Day of December 1983

[SEAL]

*Attest:*

GERALD J. MOSSINGHOFF

*Attesting Officer*

*Commissioner of Patents and Trademarks*